US005971746A

United States Patent [19]

Givens et al.

[11] Patent Number: 5,971,746

[45] Date of Patent: Oct. 26, 1999

[54] DUAL PRESSURE GAS SUPPLY CONTROLLER SYSTEM FOR GAS-BURNING APPARATUS

[75] Inventors: William A. Givens, Genoa; Geoffrey R. Ford, Redfield; Davonna L. Ridley, Lockesburg, all of Ak.; Keith C. Cathey, Texarkana, Tex.

[73] Assignee: Arkla, Little Rock, Ark.

[21] Appl. No.: 09/145,682

[22] Filed: Sep. 2, 1998

[51] Int. Cl.[6] ..... F23N 5/00

[52] U.S. Cl. ..... 431/12; 431/89; 137/110

[58] Field of Search ..... 137/110; 431/12, 431/89, 18, 62

[56] References Cited

U.S. PATENT DOCUMENTS

| | | | |
|---|---|---|---|
| 2,643,208 | 6/1953 | Ogden et al. | 137/110 |
| 3,188,836 | 6/1965 | Kniebes | 67/119 |
| 3,330,133 | 7/1967 | Kniebes | 67/119 |
| 3,632,283 | 1/1972 | Kniebes | 431/60 |
| 4,867,191 | 9/1989 | Walters | 137/78.1 |
| 5,468,142 | 11/1995 | Koziol | 431/18 |
| 5,478,232 | 12/1995 | Dillinger et al. | 431/255 |
| 5,503,549 | 4/1996 | Iasella | 431/18 |

OTHER PUBLICATIONS

Automatic Switch Co., *Installation & Maintenance Instructions: General Purchase or Raintight/Explosionproof Solenoids* (*Series 8010*) (Florham Park, NJ 1985).

Fisher Controls, Inc., *Type S100 and S102 Pressure Regulators* (Bull. 71.1:S100 Jul. 1984).

*Primary Examiner*—Carroll Dority

*Attorney, Agent, or Firm*—Jones, Day, Reavis & Pogue

[57] ABSTRACT

A dual pressure gas supply controller system is disclosed which provides apparatus and methods for supplying gas from a gas supply source to one or more gas-burning apparatus requiring two different gas pressure levels. According to the invention, a first gas pressure is supplied the gas-burning apparatus during a first time period, while a second lower gas pressure is supplied to the gas-burning apparatus during a second time period for the purpose of conserving gas. This is accomplished through the use of first and second gas pressure regulators coupled in parallel between the gas supply source and the gas-burning apparatus. A gas pressure control valve is utilized to stop the flow of gas from the first gas pressure regulator and enable the flow of gas from the second gas pressure regulator during the second time period. The gas pressure control valve can also be used to enable the flow of gas from the first gas pressure regulator and reduce the flow of gas from the second gas pressure regulator during the first time period. The gas pressure control valve can be controlled by an electrical circuit, such as a PLC to provide maximum automated performance.

14 Claims, 1 Drawing Sheet

DUAL PRESSURE GAS SUPPLY CONTROLLER SYSTEM FOR GAS-BURNING APPARATUS

BACKGROUND OF THE INVENTION

1. Field of the Invention

The present invention relates to the field of gas supply controller systems. More particularly, this invention relates to apparatus and methods for supplying natural gas from a gas supply source to one or more gas-burning apparatus requiring two different gas pressure levels.

2. Description of Related Art Including Information Disclosed Under 37 CFR 1.97 and 1.98

Many types of apparatus require natural gas to make them operational. Most of these devices, however, do not always require a constant optimal gas pressure to make them function as intended, especially during periods when the particular apparatus are intended to remain idle. Gas furnaces, for example, are not required to operate when the ambient temperature has reached a certain elevated level. Similarly, gas-operated lamps are not required during hours of daylight. To conserve gas, then, various mechanisms have been developed to automatically reduce the amount of gas flowing from the gas supply source to the gas-burning apparatus during such idle periods.

The most common way to reduce the flow of gas to the apparatus is to couple it with some sort of switching mechanism, such as a thermostat or solar cell. This switching mechanism is typically used to engage a valve located between the gas supply source and the apparatus for the purpose of stopping or reducing the flow of gas to the apparatus at user-defined intervals. Often, a small bypass is also provided to supply minimally sufficient gas to support the pilot operations of the apparatus when the valve is engaged.

The problem with the switching mechanisms previously developed is that they are either configured to operate with only one gas-burning apparatus or designed to interrupt or supply the flow of gas abruptly. In the case of gas lamps, for example, all previously invented gas lamp dimmer systems have been limited to control a single gas lamp, with severe limitations being placed upon the size of the lamp. However, these limitations unnecessarily force the consumer (who is attempting to save money by reducing the gas consumption of the lamps) to purchase, install, adjust, and maintain an equal number of specially fitted gas lamps and dimmers. Also, the performance of the gas lamp itself may be diminished because the life of the mantles is often reduced through the sudden fluctuations of gas pressures experienced whenever the gas flow to the lamp is abruptly enabled or stopped. The mechanisms devised for gas lamps also suffer from the fact that they have been designed in many cases to leave the gas lamps they control bright during all hours of darkness. The reason for this is that a typical mechanism for conserving gas uses a dimmer switch activated by a photocell.

The present invention has several advantages over the switching mechanisms presently used for conserving gas. Specifically, the present invention places no limitation on the size or quantity of gas-burning apparatus employed. A plurality of gas lamps, for example, can be coupled to the present invention and will brighten and dim simultaneously to the same level of brightness with only a single adjustment made to the controller system described herein. Moreover, the adjustments made to the gas flow are gradual, as opposed to abrupt, making the change from one brightness level to another (in the case of gas lamps) gradual and much less detrimental to the life of the mantles. The present invention can also be programmed to supply gas (e.g., for brightening or dimming gas lamps) as often as needed during any 24-hour period. The ability to program the dimmer system allows the consumer to control the length of time gas lamps are bright and dim, thereby obviating the need for the gas lamps to remain bright during all hours of darkness.

A fundamental feature of an embodiment of the present invention is that it controls the amount of gas pressure supplied to the gas-burning apparatus through the use of regulators that sense the pressure on the gas line feeding natural gas to the coupled gas-burning apparatus. This is a marked difference between all known previously invented switching mechanisms, which merely control the operation of the coupled apparatus by simply restricting the flow of gas. In contrast to the present invention, these switching mechanisms do not sense or maintain a constant pressure.

The ability to regulate the gas pressure by sensing the pressure in the gas supply line enables the present invention to control a varying number of gas-burning apparatus without making adjustments to the dimmer system or changing components on the system. In order for the previously invented switching mechanisms to control multiple gas-burning apparatus, the size of the switching mechanism (e.g., the thermostat or dimmer) would have to be increased greatly and would have to be sized and configured for each application according to the number of apparatus to be controlled. This is a great disadvantage because the switching mechanism must be reconfigured anytime an apparatus is added to or removed from the system. This is not a problem with the present invention because it can easily adapt itself to increased or decreased loads. For the foregoing reasons, therefore, the present invention constitutes a significant advancement over the prior art.

SUMMARY OF THE INVENTION

The present invention is designed to effectively and efficiently control the usage of large numbers of gas-burning apparatus simultaneously. The dual pressure gas supply controller system described herein supplies gas from a gas supply source to at least one gas-burning apparatus in the form of first and second gas pressures and can be used with any apparatus requiring two different gas pressure levels.

The first gas pressure is supplied to one or more gas-burning apparatus during a first time period to minimize the optimal amount of gas supplied to the apparatus. In contrast, the second lower gas pressure is supplied to the gas-burning apparatus during a second different time period to conserve gas. This is accomplished through the use of first and second gas pressure regulators coupled in parallel between the gas supply source and the gas-burning apparatus and through the use of a gas pressure control valve coupled to the first and second gas pressure regulators. When the gas pressure control valve is engaged to stop the gas flow from the first gas pressure regulator, the valve enables the flow of gas from the second gas pressure regulator only during the second different time period to provide the second lower gas pressure. When the gas pressure control valve is engaged to enable the flow of gas from the first gas pressure regulator, the valve reduces the flow of gas from the second gas pressure regulator only during the first time period to provide the first gas pressure.

The method described herein of supplying a desired gas pressure to one or more gas-burning apparatus is comprised of the steps of supplying a first gas pressure with a first gas pressure regulator to the apparatus only during a first time period to minimize the optimal amount of gas supplied to the apparatus, supplying a second lower gas pressure with a second gas pressure regulator to the apparatus only during a second time period to conserve gas, and controlling the first and second gas pressures with a gas pressure control valve having open and closed positions coupled to the first and second gas pressure regulators to selectively stop the flow of gas from the first gas pressure regulator and enable the flow of gas from the second gas pressure regulator only during the second time period to provide the second lower gas pressure to the apparatus and conserve gas and to selectively enable the flow of gas from the first gas pressure regulator and reduce the flow of gas from the second gas pressure regulator only during the first time period to minimize the optimal amount of gas supplied to the apparatus.

These and other aspects and advantages of the present invention will become better understood with reference to the following description, drawings, and appended claims.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

1. Controller System Overview

Figure 1:
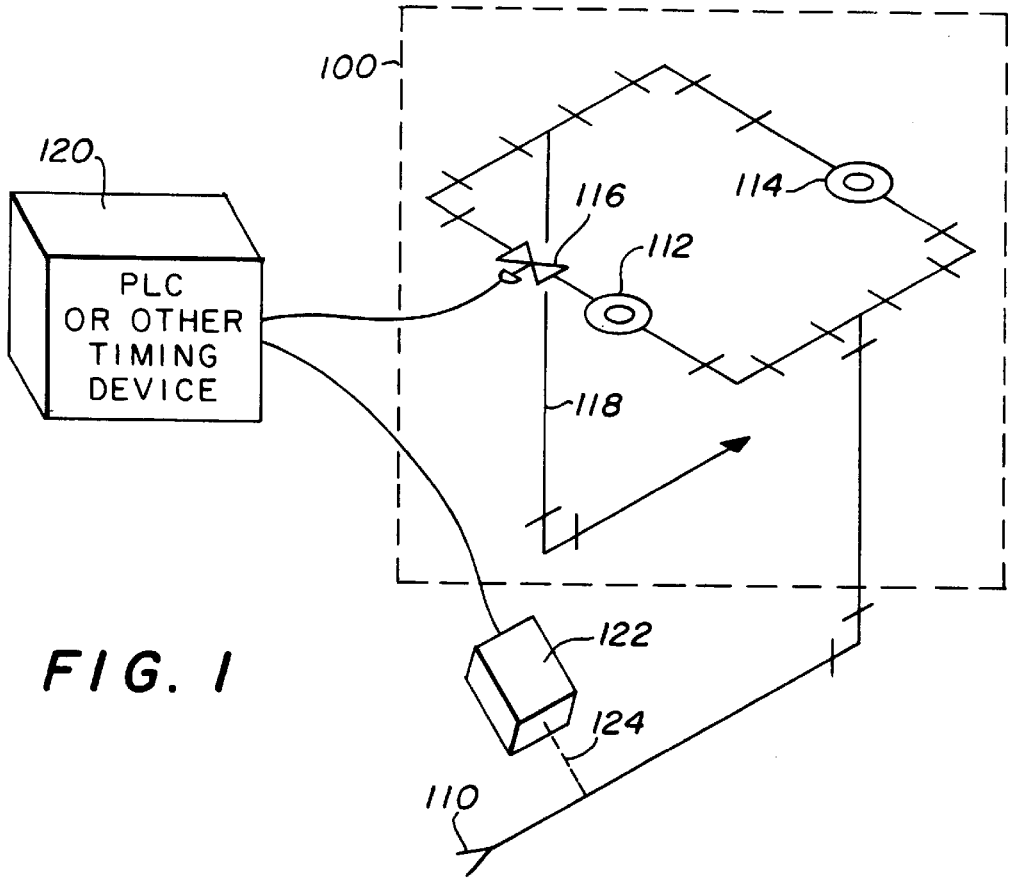
FIG. 1 is a schematic diagram of a configuration of the present invention according to one embodiment.

FIG. 1 is a schematic diagram of a configuration upon which an embodiment of the present invention can be implemented. The dual pressure gas supply controller system 100 (referred to as controller system) includes a gas supply source 110 coupled to the upstream portions of a first gas pressure regulator 112 and a second gas pressure regulator 114. The downstream portion of the first gas pressure regulator 112 is further coupled in gas flow series to a gas pressure control valve 116, which is still further coupled to a gas supply outlet conduit 118 and the downstream portion of the second gas pressure regulator 114. In addition to being coupled to the downstream portion of the gas pressure control valve 116, the downstream portion of the second gas pressure regulator 114 is likewise coupled to the gas supply outlet conduit 118. The gas supply outlet conduit 118 is still further coupled to one or more gas-burning apparatus, such as gas lamps or other devices.

The gas pressure control valve 116 operates to stop or enable the flow of gas from the downstream portion of the first gas pressure regulator 112 to the gas supply outlet conduit 118. Similarly, the gas pressure control valve 116 stops or enables the flow of gas from the downstream portion of the first gas pressure regulator 112 to the downstream portion of the second gas pressure regulator 114. Accordingly, then, the first gas pressure regulator 112 and the second gas pressure regulator 114 are aligned in parallel between the gas supply source 110 and one or more gas-burning apparatus coupled to controller system 100, with the flow of gas from the downstream portion of the first gas pressure regulator 112 to both the gas supply outlet conduit 118 and the downstream portion of the second gas pressure regulator 114 being determined by the operation of gas pressure control valve 116.

In a preferred embodiment, the gas pressure control valve 116 is a solenoid valve that is opened or closed using a programmable logic controller (PLC) or other circuit 120 as described hereafter. In an alternative embodiment, the gas pressure control valve 116 is manually opened or closed to stop or enable the flow of gas from the downstream portion of the first gas pressure regulator 112. In yet another embodiment, the gas pressure control valve 116 is incorporated as an integral component of the downstream portion of the first gas pressure regulator 112 and is operated either manually or using a PLC circuit 120.

The first gas pressure regulator 112 and the second gas pressure regulator 114 provide, respectively, a first gas pressure and a second gas pressure through gas supply outlet conduit 118 to one or more gas-burning apparatus coupled to controller system 100. In a preferred embodiment, when the gas pressure control valve 116 is in the closed position (thus stopping the flow of gas from the first gas pressure regulator 112 ), only the second gas pressure from the second gas pressure regulator 114 is released through the gas supply outlet conduit 118 to one or more gas-burning apparatus coupled to controller system 100. Conversely, in the preferred embodiment, when the gas pressure control valve 116 is in the open position (thus enabling the flow of gas from the first gas pressure regulator 112), only the first gas pressure from the first gas pressure regulator 112 is released through the gas supply outlet conduit 118 to one or more gas-burning apparatus coupled to controller system 100.

In the preferred embodiment, the first gas pressure supplied by the first gas pressure regulator 112 is that amount of gas pressure released though gas supply outlet conduit 118 which is minimally sufficient to provide optimal performance of the gas-burning apparatus to which controller system 100 is coupled. In the case of most two-mantle (double-inverted) gas lamps, for example, the first gas pressure supplied by the first gas pressure regulator 112 and released through gas supply outlet conduit 118 is about three ounces. Of course, the most preferred first gas pressure supplied by the first gas pressure regulator 112 naturally depends upon the quantity and specific requirements of the gas-burning apparatus coupled to controller system 100. In no event, however, should the first gas pressure exceed that which would cause damage to components of the gas-burning apparatus (e.g., damage to gas lamp mantles).

Conversely, the preferred second gas pressure supplied by the second gas pressure regulator 114 is that amount of gas pressure released through gas supply outlet conduit 118 which is sufficient to, at least, provide maximum gas conservation while the gas-burning apparatus coupled to controller system 100 are in reduced-gas-consumption mode. In the case of two-mantle (double-inverted) gas lamps, for example, the second gas pressure supplied by the second gas pressure regulator 114 should be the minimum amount of pressure needed to support the pilot operations of the gas lamps, which in most situations is about one ounce. As is the case with respect to the first gas pressure, the most preferred second gas pressure supplied by the second gas pressure regulator 114 naturally depends upon the quantity and specific requirements of the gas-burning apparatus coupled to controller system 100. In an alternative embodiment, the second gas pressure is any amount of gas pressure that is less than the first gas pressure.

The adjustment of the first gas pressure regulator 112 and the second gas pressure regulator 114 depends upon the configuration of the specific make(s) and model(s) of regulators selected to implement controller system 100. In this regard, the first gas pressure regulator 112 and the second gas pressure regulator 116 can be adjusted manually (e.g., by hand) or automatically using the PLC 120 to supply, respectively, the first and second gas pressures. In a preferred embodiment, however, the second gas pressure regulator 114 is adjusted automatically by sensing the gas back pressure caused by the presence of the first gas pressure (resulting from the opening of the gas pressure control valve 116) and reducing the second gas pressure to zero ounces. Alternatively, the second gas pressure is reduced to an amount greater than zero ounces but less than the first gas pressure to produce a gas pressure through gas supply outlet conduit 118. The first gas pressure should be adjusted downward to account for the coexistence of the second gas pressure and to ensure that the gas pressure released through gas supply outlet conduit 118 does not exceed that amount of gas pressure which is minimally sufficient to provide optimal performance of the gas-burning apparatus to which controller system 100 is coupled.

The first gas pressure regulator 112 and second gas pressure regulator 114 can be selected from literally thousands of different makes and models of regulators for reducing gas pressure that fit the specific type and quantity of gas-burning apparatus. The table below shows the capacity data of two readily available Fisher® brand regulators (Fisher Controls, Inc., Marshalltown, Iowa) that could easily be incorporated into the construction of controller system 100.

| Type | Inlet Pressure | Outlet Pressure | Capacity in SCFH | Maximum Number Of 1000 BTU Mantles | Maximum Number Of 2-Mantle Gas Lamps | Maximum Number Of 3-Mantle Gas Lamps | Maximum Number Of 4-Mantle Gas Lamps | Maximum Number Of 8-Mantle Gas Lamps |
|---|---|---|---|---|---|---|---|---|
| S102 | 5 psig | 5" w.c. | 1,400 | 1,400 | 700 | 487 | 350 | 175 |
| 133L | 60 psig | 5" w.c. | 169,000 | 169,000 | 84,500 | 56,333 | 42,250 | 21,125 |

Again, these are just two of many possible regulators that can be employed to fit a particular need.

A preferred embodiment of controller system 100 configured for two-mantle (double-inverted) gas lamps, utilizes two Fisher-type S102, one-inch gas pressure regulators, piped in parallel, with a solenoid gas pressure control valve 116 in gas flow series with the first gas pressure regulator 112 set at approximately five inches of water column pressure. The second gas pressure regulator 114 is set at approximately two inches of water column pressure. This configuration is adequate to supply first and second gas pressures for 1 to 700 two-mantle (double-inverted) natural gas street and yard lights and is ideally suited for most residential, "subdivision"-type situations.

2. PLC Overview

Figure 2:
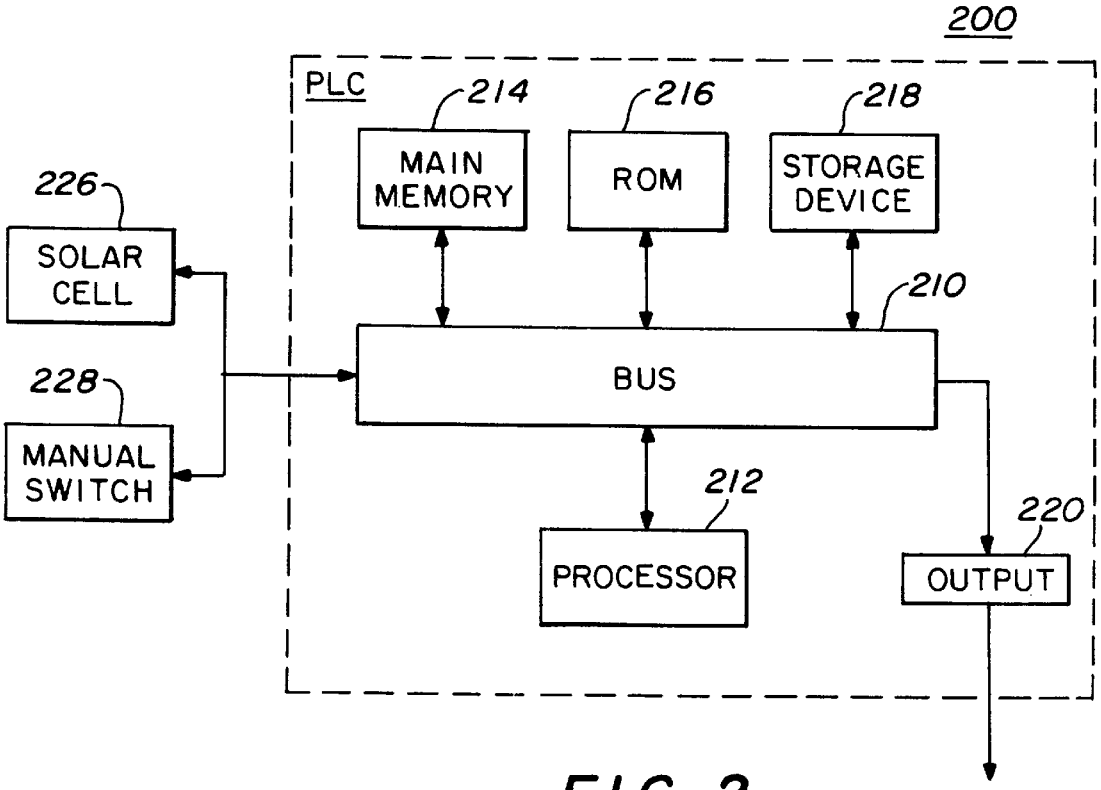
FIG. 2 is a high-level block diagram of a programmable logic controller (PLC) with which the present invention can be implemented.

In FIG. 1, PLC 120 can also be coupled to a solenoid-operated gas pressure control valve 116 to implement an embodiment of the present invention. The PLC may be of a type such as a Sematic 37-200 manufactured by SEIMENS. PLC 200, as is well known in the art, comprises a random access memory (RAM) or other dynamic storage device 214 (referred to as main memory), coupled to bus 210 for storing information and instructions to be executed by processor 212. Main memory 214 also may be used for storing temporary variables or other intermediate information during execution of instructions by processor 212. In FIG. 2, PLC 200 also comprises a read only memory (ROM) and/or other static storage device 216 coupled to bus 210 for storing static information and instructions for processor 212. An output signal is generated at output device 220. A data storage device 218, such as a magnetic disk and its corresponding disk drive, can be coupled to bus 210 for storing information and instructions.

In one embodiment, PLC 200 is used to control the opening and closing of the gas pressure control valve 116 according to a set of user-defined instructions. According a preferred embodiment, this task is performed by PLC 200 in response to processor 212 executing sequences of instructions contained in main memory 214 or from another computer-readable medium, such as data storage device 218. Execution of the sequences of instructions contained in main memory 214 causes PLC 200 to emit or cease emitting an electrical charge to the solenoid unit coupled to the gas pressure control valve 116, thereby determining whether the gas pressure control valve 116 is open or closed. In alternative embodiments, hard-wired circuitry may be used in place of or in combination with software instructions to control the solenoid unit coupled to the gas pressure control valve 116. Thus, the PLC 120 is not limited to any specific combination of hardware circuitry and software.

The user-defined instructions can vary widely from whether the input is received from a solar cell that indicates a period of darkness, whether a manual switch 228 is in the "on" position, whether the user desires the gas pressure control valve 116 to be opened or closed at predetermined times for predetermined time periods, to any combination thereof. For example, the user may want to supply gas lamps with the first gas pressure only between the hour of first darkness (controlled by input received from a solar cell 226) and 11:30 pm (controlled by the predetermined time). During the period between 11:30 pm and the next evening, therefore, the gas lamps will be supplied with the lower second gas pressure, thereby conserving gas. Using this combined configuration, the user would have to make fewer adjustments as the days get shorter and nights get longer during seasonal changes.

As reflected in FIG. 1, PLC 120 is coupled to power supply 122. Power supply 122 provides the energy source needed to operate PLC 120 and can take many forms. In one embodiment, power supply 122 is a battery that supplies direct current electricity to PLC 120. In another embodiment, power supply 122 is an alternating current electrical energy source. In yet another embodiment, power supply 122 is a solar panel used for converting solar energy into electricity. In yet a further embodiment, power supply 122 is an electrical power generator coupled to gas supply source 110 via a conduit 124 for obtaining the natural gas fuel needed to operate the generator. Alternatively, the power generator can be operated using gasoline or a similar fossil-fuel energy source.

EXAMPLE

A prototype of controller system 100 has been constructed and field conditions were simulated. Standard gas pressure regulation and a standard gas control valve were used in the prototype.

The corresponding structures, materials, acts, and equivalents of all means or step plus function elements in the claims below are intended to include any structure, material, or act for performing the function in combination with other claimed elements as specifically claimed.

We claim:

1. A dual pressure gas supply controller system for supplying gas from a gas supply source to at least one gas-burning apparatus comprising:

first and second gas pressure regulators coupled in parallel between said gas supply source and said at least one gas-burning apparatus for supplying a first gas pressure to said at least one gas-burning apparatus during a first time period to minimize the optimal amount of gas supplied to said at least one gas-burning apparatus and a second lower gas pressure to said at least one gas-burning apparatus during a second different time period to conserve gas; and a gas pressure control valve coupled to said first and second gas pressure regulators for stopping the gas flow from the first gas pressure regulator and enabling the flow of gas from the second gas pressure regulator only during the second different time period to provide said second lower gas pressure and enabling the flow of gas from said first gas pressure regulator and reducing the flow of gas from the second gas pressure regulator only during the first time period to provide said first gas pressure.

2. The gas supply controller system of claim 1 further comprising adjusting means associated with said first and second gas pressure regulators to provide said first gas pressure and said second lower gas pressure respectively for said at least one gas-burning apparatus.

3. The gas supply controller system of claim 2 wherein said second gas pressure regulator is adjusted to close by gas back pressure from the first gas pressure regulator when it is enabled to provide said first gas pressure.

4. The gas supply controller system of claim 2 wherein the gas pressure control valve is a solenoid valve in gas flow series with only the first gas pressure regulator to apply or remove the first gas pressure to said at least one gas-burning apparatus.

5. The gas supply controller system of claim 4 wherein said second gas pressure regulator is adjusted to stop the flow of gas therethrough by gas back pressure whenever the first gas pressure is supplied through said solenoid valve to said at least one gas-burning apparatus during said first time period by the first gas pressure regulator.

6. The gas supply controller system of claim 5 further including an electrical circuit coupled to said solenoid valve for opening and closing said solenoid valve to cause said first and second gas pressures to be supplied to said at least one gas-burning apparatus during said selected time periods.

7. The gas supply controller system of claim 6 wherein said electrical circuit is a programmable logic controller for opening and closing said solenoid valve at predetermined times for predetermined time periods.

8. The gas supply controller system of claim 7 further including a power supply for operating said programmable logic controller.

9. The gas supply controller system of claim 6 wherein said electrical circuit receives input from a solar cell, causing said solenoid valve to close when sufficient daylight is present and to open when sufficient darkness is present.

10. The gas supply controller system of claim 6 further including a manually operated switch coupled to said programmable logic controller to enable said solenoid valve to be controlled manually.

11. The gas supply controller system of claim 1 wherein said gas-burning apparatus is a gas lamp.

12. A method of supplying a desired gas pressure to at least one gas-burning apparatus comprising the steps of:

supplying a first gas pressure with a first gas pressure regulator to said at least one gas-burning apparatus only during a first time period to minimize the optimal amount of gas supplied to said at least one gas-burning apparatus;

supplying a second lower gas pressure with a second gas pressure regulator to said at least one gas-burning apparatus only during a second time period to conserve gas; and controlling said first and second gas pressures with a gas pressure control valve having open and closed positions and being coupled to said first and second gas pressure regulators to selectively stop the flow of gas from the first gas pressure regulator and enable the flow of gas from the second gas pressure regulator only during the second time period to provide said second lower gas pressure to said at least one gas-burning apparatus and conserve gas and to selectively enable the flow of gas from the first gas pressure regulator and to reduce the flow of gas from the second gas pressure regulator only during the first time period to minimize the optimal amount of gas supplied to said at least one gas-burning apparatus.

13. The method of claim 12 further including the step of adjusting said first and second gas pressure regulators to respectively supply said first and second gas pressures.

14. The method of claim 12 further including the step of supplying said desired gas pressure to a gas lamp as said gas-burning apparatus.

* * * * *